US005192156A

United States Patent [19]

Webb

[11] Patent Number: 5,192,156

[45] Date of Patent: Mar. 9, 1993

[54] DRAIN APPARATUS WITH LIQUID TRAP

[75] Inventor: James E. Webb, Richmond, Calif.

[73] Assignee: Nsertaseal Corporation, Richmond, Calif.

[21] Appl. No.: 706,322

[22] Filed: May 28, 1991

[51] Int. Cl.[5] ..... E01C 11/22

[52] U.S. Cl. ..... 404/4; 137/247.49

[58] Field of Search ..... 404/2-5; 29/890.146; 137/2, 160, 161, 247.41, 247.49, 362; 425/812

[56] References Cited

U.S. PATENT DOCUMENTS

| | | | |
|---|---|---|---|
| 325,231 | 9/1885 | Badgley | 404/4 |
| 712,194 | 10/1902 | Kelly | 404/4 |
| 1,005,371 | 10/1911 | Union | 404/4 |
| 1,654,803 | 1/1928 | Griffith | 404/4 |
| 3,516,541 | 6/1970 | Hardinham . | |
| 3,556,993 | 1/1971 | Persson . | |
| 4,682,907 | 7/1987 | Gaudin . | |
| 4,776,722 | 10/1988 | Gaudin . | |

FOREIGN PATENT DOCUMENTS

| | | | |
|---|---|---|---|
| 432531 | 12/1911 | France | 404/4 |
| 2556 | 11/1859 | United Kingdom | 404/4 |
| 24579 | 12/1895 | United Kingdom | 404/4 |
| 320199 | 12/1928 | United Kingdom | 404/4 |

*Primary Examiner*—Ramon S. Britts
*Assistant Examiner*—Roger J. Schoeppel
*Attorney, Agent, or Firm*—Thomas R. Lampe

[57] ABSTRACT

Apparatus for draining liquid from a surface into a sewer through a passageway extending between the surface and the sewer and for forming a liquid barrier between the sewer and the surface to prevent the flow of gases from the sewer to the surface. The apparatus incorporates structure which facilitates the flow of drainage liquid therethrough.

4 Claims, 1 Drawing Sheet

DRAIN APPARATUS WITH LIQUID TRAP

TECHNICAL FIELD

This invention relates to apparatus for draining liquid from a surface into a sewer through a passageway extending between the surface and the sewer. The apparatus is so constructed as to form a liquid barrier between the sewer and the surface for preventing the flow of gases from the sewer to the surface.

BACKGROUND ART

A number of devices are known in the prior art which allow for drainage of a liquid from a surface while at the same time forming a liquid barrier to prevent the release or escape of gases from the sewer into the ambient atmosphere. Examples of prior art disclosing such feature are U.S. Pat. No. 4,682,907, issued Jul. 28, 1987 and U.S. Pat. No. 4,776,722, issued Oct. 11, 1988. These patents both relate to self-sealing sewer cover assemblies for preventing flammable gases from being discharged from a sewer and for preventing the ignition of gases in a sewer by flames and sparks in the area adjacent to the sewer inlet. The apparatus disclosed in these patents includes a cover assembly which may replace or be used in combination with an existing cover or grating on a sewer inlet and may be inserted into the sewer inlet. The apparatus construction disclosed in these patents provide a liquid barrier between the gases contained in the sewer and the ambient air adjacent to the sewer inlet which prevents the flow of gases from the sewer to the ambient air surrounding the sewer inlet.

U.S. Pat. No. 3,516,541, issued Jun. 23, 1970, discloses a prefabricated drain safety device which is removably mounted in a vertical drain structure. The device, when partially filled with water, provides a seal preventing upward discharge of explosive vapors through the drain structure into the ambient atmosphere.

U.S. Pat. No. 3,556,993, issued Jan. 19, 1971, discloses a surface drain with water trap. The device consists of a flush surface drain with a removable grid. Within the outer casing of the drain a sump is formed. A removable baffle is spaced from an inner wall of the sump so as to leave a gap between the baffle and sump wall and form a trap within the sump.

DISCLOSURE OF INVENTION

While the apparatus of the present invention also performs the dual function of operating as a surface drain and as a barrier to sewer gases which might cause considerable harm if vented into the ambient atmosphere, the apparatus incorporates unique structure which cooperates to improve drainage efficiency as well as to promote safety. In particular, the apparatus disclosed herein utilizes a combination of structural components to define a flow path of specified character which promotes the flow of drainage liquid therethrough. Also, the apparatus is so constructed as to lessen the likelihood that material entering the apparatus will rebound, that is, splash back up and out of the apparatus.

The apparatus includes a conduit including a peripheral wall defining an interior and having an upper end and a lower end.

Support means is provided for supporting the conduit within the passageway with the lower end of the conduit below the surface from which liquid is being drained. The conduit upper end is substantially open and provides communication between the interior and ambient atmosphere above the surface.

A bottom wall is connected to the conduit peripheral wall and partially extends across the lower end to define an opening at the lower end with the peripheral wall.

A partition extends upwardly from the bottom wall and is connected to the peripheral wall to define a trough within the conduit interior. The partition has a distal end spaced from the lower end.

A deflector is connected to the peripheral wall and disposed above the partition and the opening. The deflector slants downwardly and has a lower deflector edge located over the trough. The deflector deflects liquid entering the conduit from the upper end and directs the deflected liquid into the trough.

The apparatus additionally comprises a baffle extending downwardly from the lower deflector edge of the deflector and having a lower distal end located in the trough above the bottom wall and below the level of the partition distal end.

The conduit peripheral wall, the baffle, and the partition define a generally S-shaped fluid flow path within the interior. The generally S-shaped fluid flow path includes a first fluid flow path portion disposed at a first side of the interior between the conduit peripheral wall and the baffle, a second fluid flow path portion between the baffle and the partition substantially parallel to the first flow path portion and communicating therewith at the conduit lower end, and a third fluid flow path portion disposed at a second side of the interior between the conduit peripheral wall and the partition. The third fluid flow path portion is substantially parallel to the first and second fluid flow path portions and in communication with the second fluid flow path portion through an aperture defined by the conduit peripheral wall, the deflector, and the partition distal end.

The third fluid flow path portion leads to the opening whereby liquid in the third fluid flow path portion flowing to the opening facilitates flow of liquid through the generally S-shaped fluid flow path.

The third fluid flow path portion is longer than the second fluid flow path portion whereby liquid in the third fluid flow path portion creates a siphoning effect on the liquid in the generally S-shaped fluid flow path.

Other features, advantages, and objects of the present invention will become apparent with reference to the following description and the accompanying drawings.

BEST MODE FOR CARRYING OUT THE INVENTION

Figure 1:
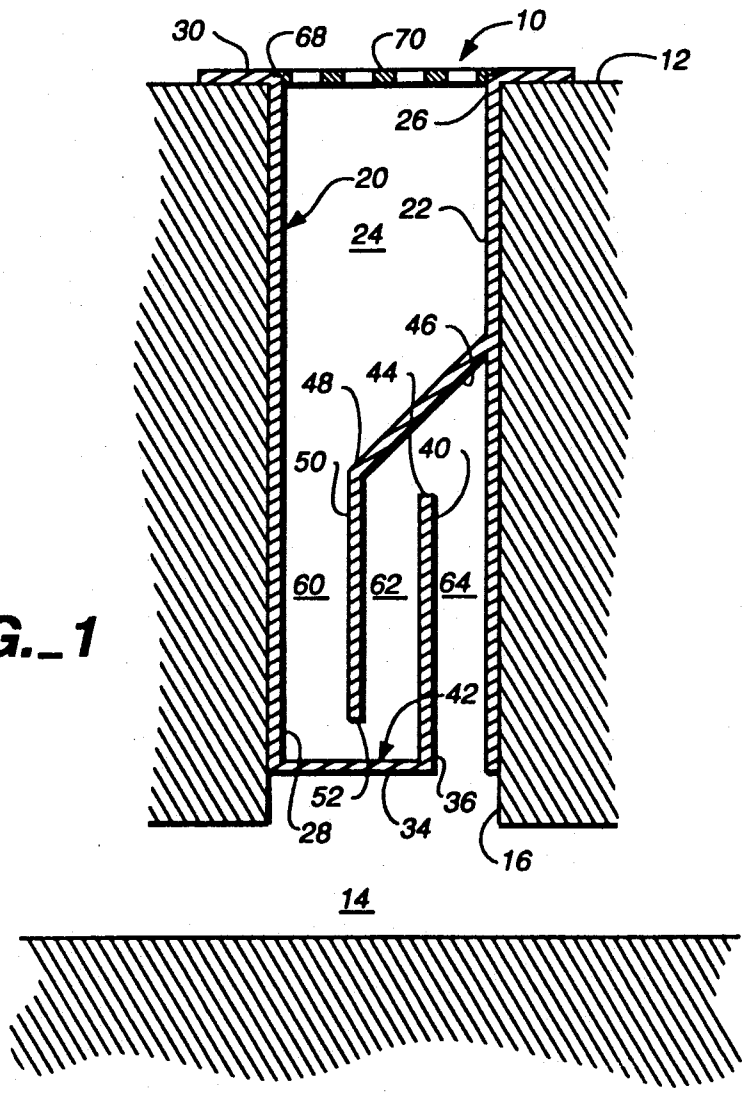
FIG. 1 is a vertical, cross-sectional view of an embodiment of the apparatus.

Referring now to FIG. 1 of the drawings, apparatus constructed in accordance with the teachings of the present invention is generally designated by reference numeral 10. Apparatus 10 is for the purpose of draining liquid from a surface 12 into a sewer 14 through a passageway 16 extending between the surface and the sewer. Apparatus 10 also serves to form a liquid barrier between the sewer and the surface for preventing the flow of gases from the sewer to the surface.

In certain industrial environments, sewers can house flammable gases which, if allowed to surface, can ignite or explode. For example, during the course of welding or other operations creating flames or sparks. Such conditions are not uncommon, for example, at petroleum refineries or chemical processing plants.

Apparatus 10 incorporates a conduit 20 including a peripheral wall 22 defining an interior 24 and having an upper end 26 and a lower end 28.

Support means in the form of a flange 30 is provided for supporting the conduit within the passageway with the lower end of the conduit below the surface 12. The conduit upper end 26 is substantially open and provides communication between the interior 24 and ambient atmosphere above the surface.

A bottom wall 34 is connected to the peripheral wall 22 and partially extends across the conduit lower end to define an opening 36 at the lower end with the peripheral wall.

A partition 40 extends upwardly from the bottom wall and is connected to the peripheral wall 22 at its ends to define a trough 42 within the conduit interior. Partition 40 has a distal end 44 spaced from the lower end of the conduit.

A deflector 46 is connected to the peripheral wall 22 and disposed above partition 40 and opening 36. The deflector 46 slants downwardly and has a lower deflector edge 48 located over trough 42.

Apparatus 10 additionally includes a baffle 50 extending downwardly from edge 48 and having a lower distal end 52 located in the trough 42 above bottom wall 34 and below the level of partition distal end 44.

In the embodiment illustrated in FIG. 1, the conduit 20, the bottom wall 34, the partition 40, the deflector 46, and the baffle 50 are fixedly connected whereby the apparatus 10 is of integral construction. It will be appreciated that any suitable material may be utilized in the construction of the apparatus, for example, metal sheet or plate welded or otherwise secured together or molded plastic material of any suitable type.

The conduit peripheral wall 22, the baffle 50, and partition 40 define a generally S-shaped fluid flow path within the interior 24. The generally S-shaped fluid flow path includes a first fluid flow path portion 60 disposed at a first side of the interior between the conduit peripheral wall and the baffle. A second fluid flow path portion 62 is formed between the baffle 50 and partition 40. Second fluid flow path portion 62 is substantially parallel to the first fluid flow path portion and communicates therewith at the conduit lower end.

A third fluid flow path portion 64 is disposed at a second side of the interior between the conduit peripheral wall 22 and partition 40. Third fluid flow path portion 64 is substantially parallel to the first and second fluid flow path portions and is in communication with the second fluid flow path portion through an aperture or opening defined by the conduit peripheral wall, deflector 46, and partition distal end 44. Third fluid flow path portion 64 leads to the opening 36 at the bottom or lower end of the conduit whereby liquid in the third fluid flow path portion flows to the opening.

It is to be noted that the third fluid flow path portion 64 is longer than the second fluid flow path portion 62 whereby liquid in the third fluid flow path portion creates a siphoning effect on the liquid in the generally S-shaped fluid flow path. Fluid flow is also facilitated by virtue of the fact that water or other liquid entering the conduit from the upper end thereof will be deflected by the deflector 46 toward the first fluid flow path portion 60. If the deflector plate were not slanted as shown and instead generally horizontal and at right angles to the longitudinal axis of the conduit, not only would considerable turbulence and resistance to liquid flow into first fluid flow path portion 60 be created but such a plate or barrier would result in splash-back of the liquid entering the apparatus.

It has been found that orienting the upper liquid impact surface of the deflector 46 generally 45 degrees relative to the longitudinal axis of the conduit 20 results in smooth flow. Water or other liquid deflected by the deflector 46 will be directed toward the peripheral wall 22 of the conduit and thence downwardly at an angle to the bottom wall 34 through first fluid flow path portion 60.

Liquid flow then continues upwardly through second fluid flow path portion 62 and tends to strike the bottom or lower liquid impact surface of the deflector 46 to reorient the water flow generally toward the direction of third fluid flow path portion 64 which, as stated above, operates to create a siphoning effect when the fluid flow path portions are filled with water or other drainage liquid. During this drainage operation as well as at all other times, the trough 42 remains filled with liquid, creating a trap to prevent the back flow of gases through the apparatus.

At the upper end thereof, conduit 20 defines a grating seat 68 which accommodates a grating 70 having apertures therein, with the grating positioned in the seat over the deflector upper liquid impact surface.

Figure 2:
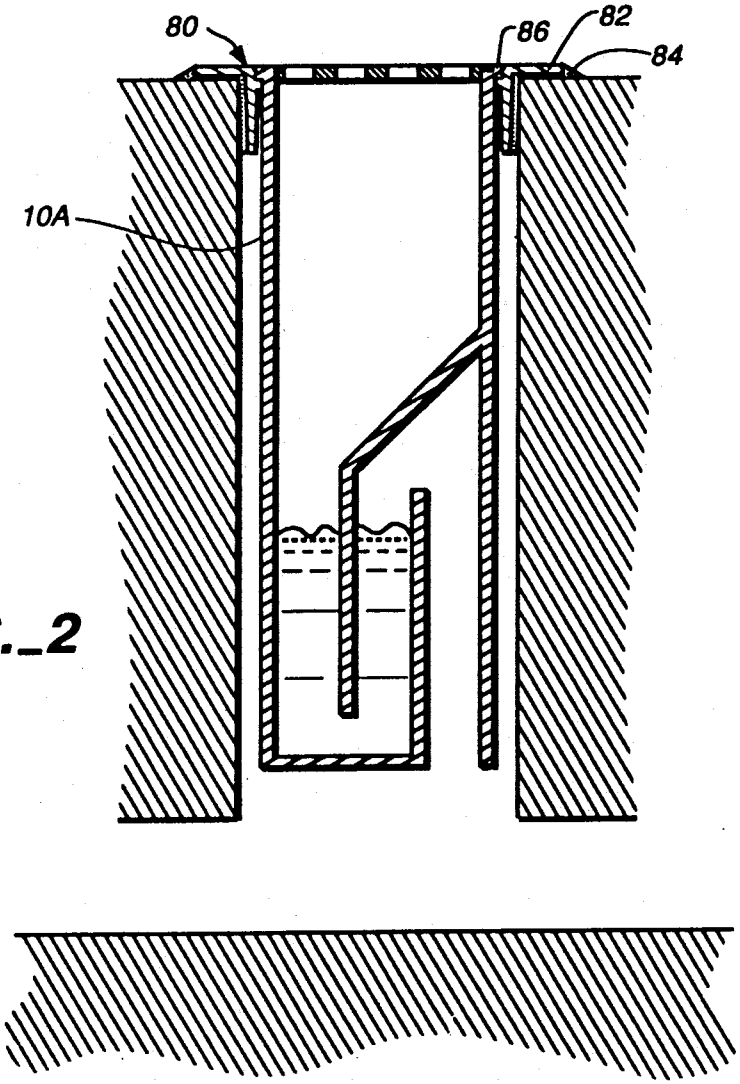
FIG. 2 is a view similar to that of FIG. 1 but illustrating an alternative embodiment of the apparatus.

The apparatus 10A shown in FIG. 2 generally corresponds in construction and operation to apparatus 10. Apparatus 10A, however, differs from that of apparatus 10 in that the support means includes not only a flange projecting from the conduit at the upper end thereof but a collar 80 which is positioned in the passageway. The collar includes a flange element 82 which is positioned on the surface 12. A sealant 84 of any suitable type may be utilized to releasably secure the collar flange 82 to the surface. The flange of the conduit 20 is located in a recess 86 formed at the top of the collar and in the arrangement illustrated the flange 30 is releasably attached in position relative to the collar 80 by screw threads. The rest of the apparatus 10A can be separated from the collar (which remains in position) by simply rotating the conduit relative to the collar and exerting an upward force on the conduit.

I claim:

1. Apparatus for draining liquid from a surface into a sewer through a passageway extending between said surface and said sewer and for forming a liquid barrier between said sewer and said surface for preventing the flow of gases from said sewer to said surface, said apparatus being selectively, positionable in said passageway and removable therefrom as a unit, and said apparatus comprising, in combination:

a conduit including a peripheral wall defining an interior and having an upper end, a lower end, and a longitudinal axis extending through upper and lower ends;

support means for supporting said conduit within said passageway with the lower end of said conduit below said surface, said conduit upper end being substantially open and defining an upwardly directed drain opening providing communication between said interior and ambient atmosphere above said surface and allowing liquid to drain from said surface directly downwardly in a vertical direction along said longitudinal axis through said drain opening into the interior of said conduit;

a bottom wall connected to said peripheral wall and partially extending across said lower end to define an opening at said lower end with said peripheral wall, said bottom wall being in partial registry with said drain opening;

a partition extending upwardly from said bottom wall and connected to said peripheral wall to define a trough within said conduit interior, said partition having a distal end spaced from said lower end;

a deflector connected to said peripheral wall and disposed above said partition and said opening and below said drain opening whereby liquid draining from said surface directly downwardly in a vertical direction through said drain opening will directly impact said deflector, said deflector slanting downwardly and having a lower deflector edge located over said trough, said deflector having an upper liquid impact surface deflecting the liquid entering said conduit through said drain opening and directly impacting said deflector and directing said deflected liquid into said trough, said deflector also having a lower impact surface disposed over a segment of said bottom wall and over said opening; and a baffle extending downwardly from the lower deflector edge of said deflector and having a lower distal end located in said trough above said bottom wall and below the level of said partition distal end, said conduit, said bottom wall, said partition, said deflector, and said baffle being fixedly connected whereby said apparatus is of integral construction, said conduit peripheral wall, said baffle, and said partition defining a generally S-shaped fluid flow path within said interior, said generally S-shaped fluid flow path including a first fluid flow path portion disposed at a first side of said interior between said conduit peripheral wall and said baffle, a second fluid flow path portion between said baffle and said partition substantially parallel to said first fluid flow path portion and communicating therewith at said conduit lower end, and a third fluid flow path portion disposed at a second side of said interior between said conduit peripheral wall and said partition, said third fluid flow path portion substantially parallel to said first and second fluid flow path portions and in communication with said second fluid flow path portion through an aperture defined by said conduit peripheral wall, said deflector, and said partition distal end, said third fluid flow path portion leading to said opening whereby liquid in said third fluid flow path portion flowing to said opening facilitates flow of liquid through said generally s-shaped fluid flow path, said third fluid flow path portion being longer than said second fluid flow path portion whereby liquid in said third fluid flow path portion creates a siphoning effect on the liquid in said generally S-shaped fluid flow path, and said deflector lower liquid impact surface for reorienting liquid flow when said liquid flows from said second fluid flow path portion into said third fluid flow path portion.

2. The apparatus according to claim 1 wherein said deflector upper and lower liquid surfaces are oriented generally 45 degrees relative to the longitudinal axis of said conduit.

3. The apparatus according to claim 2 wherein said conduit defines a grating seat at the upper end thereof, said apparatus additionally comprising a grating positioned in said seat over said deflector upper liquid impact surface.

4. The apparatus according to claim 1 wherein said support means includes collar means extending downwardly from said surface at least partially positioned in said passageway and defining a throughbore, and a flange projecting from said conduit at the upper end thereof, said flange being supported by and releasably engageable with said collar means when said conduit is in said passageway.

* * * * *